United States Patent [19]

Mendelsohn et al.

[11] 4,081,298

[45] Mar. 28, 1978

[54] HEAT TREATMENT OF IRON-NICKEL-PHOSPHORUS-BORON GLASSY METAL ALLOYS

[75] Inventors: Lewis Isaac Mendelsohn, Morristown; Kevin James Durand, New Providence; Ethan Allen Nesbitt, Beach Haven, all of N.J.

[73] Assignee: Allied Chemical Corporation, Morris Township, N.J.

[21] Appl. No.: 721,007

[22] Filed: Sep. 7, 1976

[51] Int. Cl.[2] ..... H01F 1/00

[52] U.S. Cl. ..... 148/121; 75/122; 148/28; 148/108; 148/122

[58] Field of Search ..... 148/121, 122, 27, 108; 75/120, 134 F, 123 D, 123 K, 122; 331/156; 260/45, 75 R

[56] References Cited

U.S. PATENT DOCUMENTS

| | | | |
|---|---|---|---|
| 3,614,893 | 10/1971 | Nesbitt et al. | 75/123 K |
| 3,820,040 | 6/1974 | Berry et al. | 331/156 |
| 3,856,513 | 12/1974 | Chen et al. | 75/122 |
| 3,865,784 | 2/1975 | Neale et al. | 260/45.75 R |

OTHER PUBLICATIONS

Polk, D. et al., Formation & Properties of Glassy Ni-Fe Alloys, in *Journ. Non-Cryst. Sol.*, June 15, 1974, p. 167.

*Primary Examiner*—Walter R. Satterfield
*Attorney, Agent, or Firm*—David W. Collins; Gerhard H. Fuchs

[57] ABSTRACT

A process is provided for improving magnetic properties of certain glassy metal alloys which comprises immersing toroidally wound cores of glassy metal alloy filaments in a thermally stable, nonferromagnetic, electrically inert and chemically unreactive liquid, maintaining the liquid at a temperature of between about 310° and 350° C for about ¾ to 8 hrs., depending on the temperature selected, and cooling the filament to about 25° C at a rate not greater than about 30° C/min. through its Curie temperature. Optionally, a magnetic field of about 1 to 10 Oe may be applied circumferentially around the cores during cooling through the Curie temperature to further improve the magnetic properties of the glassy metal alloy.

8 Claims, No Drawings

HEAT TREATMENT OF IRON-NICKEL-PHOSPHORUS-BORON GLASSY METAL ALLOYS

BACKGROUND OF THE INVENTION

1. Field of the Invention

This invention relates to improvement of magnetic properties of glassy metal alloys and, more particularly, to heat treatment of toroidally wound cores of filaments of glassy metal alloys with or without an externally applied magnetic field.

2. Description of the Prior Art

Crystalline, high permeability 80% nickel/20% iron alloys achieve their outstanding magnetic properties as a result of cold reduction followed by an 1100° C anneal in pure dry hydrogen. This high temperature makes it difficult to maintain dimensional tolerances. Moreover, objects of irregular shape must be coated with a ceramic (usually aluminum oxide) to prevent pressure welding or sticking during heat treatment. Also important, parts must be carefully supported during heat treatment to prevent dimensional distortion. At temperatures above 600° C, a protective atmosphere such as pure, dry (−70° C dew point) hydrogen must be provided to eliminate the possibility of oxidation. A good vacuum ($10^{-8}$ m or less) may be used as a substitute for hydrogen. However, this demands the use of a high temperature vacuum furnace.

Recently, studies have been reported concerning the magnetic annealing of a glassy metal alloy, $Fe_{40}Ni_{40}P_{14}B_6$ (the subscripts are in atom percent); see Vol. 11, *IEEE Transactions on Magnetics*, pp. 1644–1649 (1975). Generally improved properties are indicated. However, it is also apparent that again either an inert atmosphere or high vacuum is required to anneal the alloy and thereby obtain the improved properties.

An economical, convenient process for heat treating toroidally wound cores of filaments of glassy metal alloys is required. Such a process requires a heat-transfer medium into which the cores may be suspended. The medium should be easy to use, easy to heat, require no complex apparatus and be able to withstand temperatures of at least 350° C without thermally decomposing. Further, such a medium must not react with the alloy or form deleterious contamination products thereon. The medium must also be an electrical insulator in order to minimize its bypassing of any magnetizing current applied for directionalizing during heat treatment.

SUMMARY OF THE INVENTION

In accordance with the invention, a process is provided for improving the magnetic properties of a substantially glassy metal alloy consisting essentially of about 38 to 42 atom percent iron, about 38 to 42 atom percent nickel, about 12 to 16 atom percent phosphorus and about 4 to 8 atom percent boron. The process comprises (a) immersing at least one toroidally wound filament of the alloy in a heat-transfer liquid heated to a temperature of between about 310° and 350° C, the liquid being thermally stable to at least 350° C, nonferromagnetic, electrically inert and substantially unreactive with the alloy, (b) maintaining the liquid at said temperature for about ¾ to 8 hrs, depending on the temperature selected, and (c) cooling the filament to about 25° C at a rate not greater than about 30° C/min through its Curie temperature. Further improved properties are obtained by applying a magnetic field of about 1 to 10 Oe circumferentially around the toroidally wound filament during cooling through the Curie temperature.

DETAILED DESCRIPTION OF THE INVENTION

Toroidally wound filaments of ferromagnetic alloys find extensive use as magnetic cores. A long continuous filament is spirally wound onto a core support, encased in a protective medium, and provided with magnetizing wires, as is well-known. As used herein, the term "filaments" is used to include both wire and ribbon forms of the magnetic alloy.

Prior to use as magnetic cores, however, it is desirable to process the filaments in some manner to improve certain magnetic properties. As is well-known, such processes include heat treating with or without an externally applied magnetic field. As described in *Metal Progress*, pp. 84–89 (August, 1957), magnetic annealing can result in a change in the coercive force ($H_c$), the permeability (B/H ratio) or the energy product (B × H), depending on composition and initial magnetic properties.

Heat treating to improve certain magnetic properties requires consideration of several parameters, including temperature of heat treatment, time of heat treatment, rate of cooling to room temperature and extent of applied magnetic field, if any. A further consideration is the choice of an efficient heat-transfer medium.

Some of these considerations are especially critical when dealing with glassy (amorphous) metal alloys such as those disclosed by Chen et al. in U.S. Pat. No. 3,856,513, issued Dec. 24, 1974. For example, glassy metal alloys, which are highly ductile when formed, crystallize at some temperature, which varies with composition, to form a crystalline product which is often brittle. Further, other properties, such as magnetic properties, may also be deleteriously affected by such crystallization. At the same time, however, the temperature of heat treatment must be such as to provide sufficient atomic mobility in the alloy for the relief of stresses within a reasonable amount of time. Further, for magnetic annealing of magnetic alloys, whether crystalline or glassy, the temperature of heat treatment must exceed the Curie temperature of the alloy in order to realize substantial improvement in magnetic properties.

The results of heat treating depend in part on the particular alloy composition being treated and its initial magnetic properties. The glassy magnetic alloys contemplated herein include alloys of nominal composition $Fe_{40}Ni_{40}P_{14}B_6$ (the subscripts are in atom percent). It will be appreciated, however, as a consequence, for example, of slight deviations in processing parameters during production of filaments of the alloy, that the amount of each component of the alloy can be varied about ±2 atom percent without appreciably altering the character of the alloy. Thus, the glassy metal alloy being processed in accordance with the invention consists essentially of about 38 to 42 atom percent iron, about 38 to 42 atom percent nickel, about 12 to 16 atom percent phosphorus and about 4 to 8 atom percent boron. Further, up to about 1 atom percent of impurities may be added without deleteriously affecting the magnetic properties or other physical properties of the alloy in the as-quenched state.

Filaments of these glassy metal alloys are conventionally produced by rapid melt quenching techniques at rates of at least about $10^{5°}$ C/min; see, e.g., U.S. Pat. No.

3,856,513. In order to be suitable for the intended purpose of magnetic cores, it is desired that these alloys be substantially glassy; that is, that at least about 80% of the alloy as quenched be glassy, as evidenced by an X-ray diffractometer scan.

Without subscribing to any particular theory, the reason for the improvement appears to arise from the fact that most ferromagnetic alloys are magnetostrictive; that is, their magnetic properties are altered as a result of applied stress. Rapid quenching associated with glassy metal processing as disclosed, for example, in U.S. Pat. 3,856,513, tends to produce nonuniform stresses in as-quenched filaments of the alloys. Heat treating apparently tends to relieve these stresses and results in an increase in the maximum permeability.

Above about 350° C, the glassy alloy begins to degrade due to the relative proximity of the crystallization temperature of about 375° C (as measured at a heating rate of about 1° C/min). Accordingly, the upper temperature of heat treatment is about 350° C. The lower temperature of heat treatment is bounded by economic considerations. At too low a temperature, there is insufficient atomic mobility to obtain the stress relief within a reasonable period of time. A temperature of about 310° C is the minimum temperature at which the desired stress relief is obtained. The optimum heat treatment temperature is about 320° to 330° C.

The exact time of heat treatment is not critical, and varies with the temperature selected, longer times being employed at lower temperatures. For maximum improvement in magnetic properties consistent with minimum degradation of the alloy, a heat treatment temperature of about 350° C requires a time interval of between about ¾ and 1½ hrs, with about 1 hr preferred, while a heat treatment temperature of about 310° C requires a time interval of between about 3 and 8 hrs, with about 4 hrs preferred. At intermediate temperatures, the times may vary between the foregoing limits. For example, at a temperature of about 320° to 330° C, the time may range from about 1¾ to 2½ hrs. For economical reasons, the shorter times at any given temperature are generally preferred.

The cooling rate can be no faster than about 30° C/min through the Curie temperature of the alloy (about 247° C for $Fe_{40}Ni_{40}P_{14}B_6$); otherwise, undesired strains are induced in the glassy metal alloy. A low cooling rate is, of course, uneconomical. A cooling rate that is sufficiently fast to be economical without inducing excessive strain is found to be about 20° to 30° C/min. The filament may be removed from the bath for cooling or may be kept in the bath, which may then be cooled. Economic considerations dictate that the former procedure is preferable.

Surprisingly, there are very few known heat-transfer liquids that can withstand the temperatures and times required for heat treating the glassy metal alloys. Many common organic fluids either decompose or react with glassy metal alloys of the compositions employed herein to form undesirable reaction products. Examples of such unsuitable liquids include tricresyl phosphate, silicone oil and the like. Indeed, the only heat-transfer liquids suitable for the heat treatment process disclosed herein are stabilized iron-containing diorganopolysiloxane compounds produced according to the process described in U.S. Pat. No. 3,865,784, issued Feb. 11, 1975. Preferably, the heat-transfer liquid consists essentially of an iron stabilized trimethyl end blocked dimethylsiloxane, available from Union Carbide under the trade designation "Y-7265 Silicone Fluid." These compositions are also nonferromagnetic and are electrically inert.

The heat treatment process disclosed herein may be carried out in the absence of an externally applied magnetic field, with an acceptable increase in magnetic properties. However, maximum improvement in magnetic properties is achieved by employing a magnetic field of about 1 to 10 Oe during cooling through the Curie temperature. Such a magnetic field must be applied circumferentially around the toroidally wound filament so as to achieve the maximum improvement in magnetic properties. The magnetic field is applied at any temperature at least about 10° above the Curie temperature and is maintained until a temperature at least about 25° below the Curie temperature is reached.

EXAMPLES

The as-quenched properties of a glassy metal alloy of nominal composition $Fe_{40}Ni_{40}P_{14}B_6$ are listed in the Table below, together with the results following heat treatment with no applied magnetic field and heat treatment with an applied magnetic field of 10 Oe. These data were measured with cores wound from ribbon weighing about 2 g, of dimensions 0.0018 inch thick by 0.070 inch wide on a suitable core box of boron nitride having a diameter of 1.25 inch. The resulting cross-section of about 0.02 $cm^2$ was suitable for magnetic testing on a hysteresigraph. A toroid of 100 turns of nickel-clad copper wire was wound around the core box to supply the circumferential magnetic directionalizing field. Glass sleeving provided suitable turn insulation, while glass tape wound over the core box provided ground insulation.

In the Table, B(0) is the induction at zero field, B(1.0) is the induction in a field of 1 Oe, $H_c$ is the coercive force, $\mu(20)$ is the DC permeability at a flux density of 20 Gauss, $\mu(100)$ is the DC permeability at a flux density of 100 Gauss and $\mu_{max}$ is the maximum permeability.

Table

| | B(0), Gauss | B(1.0), Gauss | $H_c$, Oe | $\mu(20)$ | $\mu(100)$ | $\mu max$ |
|---|---|---|---|---|---|---|
| As-quenched | 3,500 | 4,000 | 0.053 | 3,700 | 7,700 | 62,000 |
| Heat treated* in Y-7265 silicone fluid, no magnetic field | 4,050 | 7,300 | 0.014 | 7,900 | 20,000 | 177,000 |
| Heat treated* in Y-7265 silicone fluid, 10 Oe circumferential field | 5,050 | 7,700 | 0.009 | 13,300 | 36,800 | 312,000 |

*325° C, 2 hr.

Clearly, use of the process disclosed herein results in substantial improvement of the magnetic properties, including an increase in induction, a decrease in coercivity, and an increase in permeability. No deleterious reaction or contamination was observed to form as a consequence of employing the silicone fluid.

What is claimed is:

1. A process for increasing induction, decreasing coercivity and increasing permeability of a substantially glassy metal alloy consisting essentially of about 38 to 42 atom percent iron, about 38 to 42 atom percent nickel, and about 12 to 16 atom percent phosphorus and about 4 to 8 atom percent boron comprising:

a. immersing at least one toroidally wound filament of said alloy in a heat-transfer liquid heated to a temperature of between about 310° and 350° C, said liquid being (1) thermally stable to at least 350° C (2) nonferromagnetic, (3) electrically inert and (4) substantially unreactive with said alloy;

b. maintaining said temperature between about 310° and 350° C for about ¾ to 8 hrs, depending on the temperature selected; and c. cooling said filament to about 25° C at a rate not greater than about 30° C/min through its Curie temperature.

2. The process of claim 1 in which said alloy has the approximate composition $Fe_{40}Ni_{40}P_{14}B_6$.

3. The process of claim 1 in which said liquid consists essentially of a stabilized iron-containing diorganopolysiloxane compound.

4. The process of claim 3 in which said liquid consists essentially of an iron stabilized trimethyl end blocked dimethylsiloxane.

5. The process of claim 1 in which said temperature is maintained at about 320° C to 330° C.

6. The process of claim 5 in which said temperature is maintained from about 1¾ to 2½ hrs.

7. The process of claim 1 in which said cooling rate is about 20° to 30° C/min.

8. The process of claim 1 in which during immersion a magnetic field of about 1 to 10 Oe is circumferentially applied around said toroidally wound filament during cooling through the Curie temperature.

* * * * *